United States Patent [19]

Robison

[11] Patent Number: 4,572,291

[45] Date of Patent: Feb. 25, 1986

[54] WELL CASING SCRAPER

[76] Inventor: Robert E. Robison, 4619 Vanderbilt Ct., Ventura, Calif. 93003

[21] Appl. No.: 668,708

[22] Filed: Nov. 6, 1984

[51] Int. Cl.[4] ..... E21B 37/02

[52] U.S. Cl. ..... 166/173; 285/32; 285/117; 403/359

[58] Field of Search ..... 166/173, 174, 176, 170, 166/241; 403/359, 259; 175/325; 308/4 A; 15/104.16; 285/391, 92, 23, 32, 117

[56] References Cited

U.S. PATENT DOCUMENTS

| | | | |
|---|---|---|---|
| 2,693,239 | 11/1954 | Emanuel | 166/173 |
| 2,845,129 | 7/1958 | Baker | 166/173 |
| 3,011,556 | 12/1961 | Best | 166/173 |
| 3,031,016 | 4/1962 | Conrad | 166/173 |
| 3,251,418 | 5/1966 | Condra | 166/173 |
| 3,757,859 | 9/1973 | Hammon | 166/173 |
| 3,827,492 | 8/1974 | Hammon et al. | 166/173 |
| 4,189,000 | 2/1980 | Best | 166/173 |
| 4,291,764 | 9/1981 | Pampell | 166/173 |
| 4,479,538 | 10/1984 | Coyle, Sr. | 166/173 |

*Primary Examiner*—James A. Leppink

*Assistant Examiner*—Hoang C. Dang

*Attorney, Agent, or Firm*—Koppel & Harris

[57] ABSTRACT

A casing scraper for well casings in which the scraper blades are positively held on the scraper body. The blades are provided with retainer arms which engage a series of splines formed integrally with the scraper body, and slide up the splines to a cutting position. The blades are held in place by a retainer ring which has two sets of threads, with a gap in between the two sets. The lower set of threads normally engages annular threading on the scraper body to bear against the lower end of the blades and hold them in place. If the ring becomes partially unscrewed, the gap between the two sets of threading tends to resist further disengagement, and the ring remains sufficiently in place to prevent the blades from unloading. The orientation of the ring threading and of the annular threading is also reversed from the scraper's direction of rotation in normal use, so that under normal rotation the ring is urged to rotate more tightly against the blades, rather than to unscrew. The ring is further held against counter-rotation by a plurality of set screws which fasten into the scraper body.

10 Claims, 4 Drawing Figures

Fig.1.
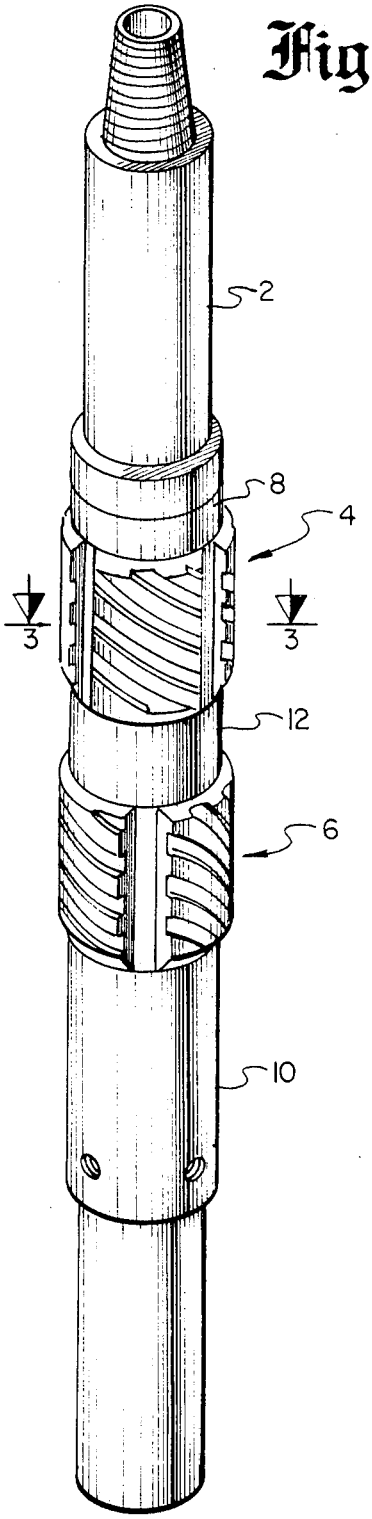
Fig.3.
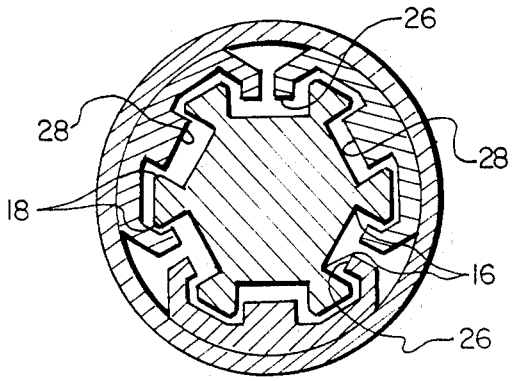
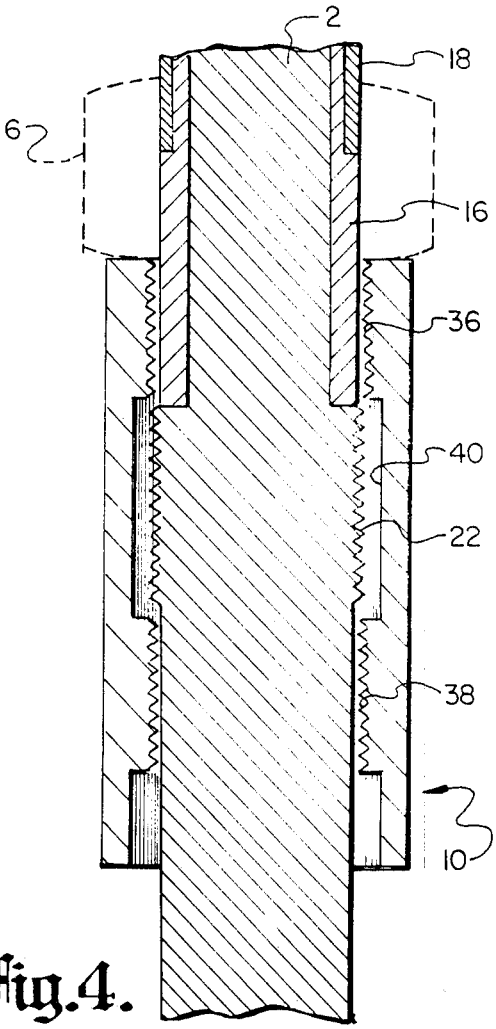
Fig.4.

WELL CASING SCRAPER

BACKGROUND OF THE INVENTION

1. Field of the Invention

This invention relates to casing scrapers used to clean the inside of a well casing.

2. Description of the Prior Art

Casing scrapers are used to remove scale, mud cake, cement sheath and other foreign material from the inside of the casing walls used in oil wells, water wells and the like. The object of the scraping is to smooth the surface of the casing and prepare it for other downhole operations such as packer setting, squeeze tools, etc.

One problem with prior scrapers is that the blades are generally spring loaded onto the scraper body or mandrel, and if the mechanism used to fasten the blades to the body should come loose the entire tool can come apart. This requires a shutdown of the scraping process and the retrieval and repair of the scraper apparatus, resulting in delays and associated expenses.

SUMMARY OF THE INVENTION

In view of the above problems associated with the prior art, an object of the present invention is the provision of a novel and improved casing scraper with a more secure mechanism for holding the scraper blades in place on the tool.

Another object is the provision of a novel and improved casing scraper which is capable of continued operation even if the blades become partially dislodged.

These and other objects are achieved in the present invention by providing the elongated scraper body with a plurality of splines which are spaced around the circumference of the body and extend longitudinally along a portion thereof. Each of the scraper blades is provided with carrier arms or other means for engaging respective splines on the body, so as to enable the blades to be slid along the splines to desired operating positions. The splines include a loading area for receiving the blades, which are retained on the body by means of their engagement with these splines. Means are provided for restraining the blades from longitudinal movement along the splines after they have been positioned, thereby preventing the blades from being unloaded.

In a preferred embodiment, a blade stop mechanism is provided at the end of the splines opposite to the loading area, while an annular threading is formed around the body on the other side of the loading area. A retainer ring is screwed over the threading to longitudinally retain the blades on the splines, the orientation of the threading being reversed from the scraper's direction of rotation in normal use so that under normal rotation the retainer ring is urged further onto the threading and against the blades. In addition, a plurality of threaded set screw openings are provided in the ring and body, with the openings aligning when the ring is screwed on to a retaining position. This enables additional retention of the ring by the insertion of set screws into the mating openings.

A further guard against the scraper parts becoming disassembled during operation is provided by forming the retainer ring with first and second spaced sets of interior threading, the gap between the two sets being wider than the longitudinal extent of the annular threading on the body. The ring is positioned by screwing the first set of threads beyond the annular threading and continuing to screw on the ring until the second set of threads engage the annular threading. In this position, even if the retainer ring should become unscrewed so that the annular threading is in the gap area, the ring tends to vibrate about the annular threading and resists engagement between the first set of ring threads and the annular threading. This prevents the ring from unscrewing all the way off. The dimensions of the ring, scraper blades, annular threading and spline loading area are selected so that the blades are still retained on the splines by the ring even if the ring becomes unscrewed to the extent that the annular threading is in the gap area between the two sets of ring threadings.

These and other features and advantages of the invention will be apparent to those skilled in the art from the following detailed description of a preferred embodiment, taken together with the accompanying drawings, in which:

DESCRIPTION OF THE DRAWINGS

FIG. 1 is an elevational view of the assembled casing scraper;

FIG. 3 is a sectional view taken along the line 3—3 of FIG. 1; and

FIG. 4 is a fragmentary sectional view showing the engagement of the blade retainer ring with the scraper body when the ring has become partially dislodged.

DETAILED DESCRIPTION OF A PREFERRED EMBODIMENT

Figure 2:
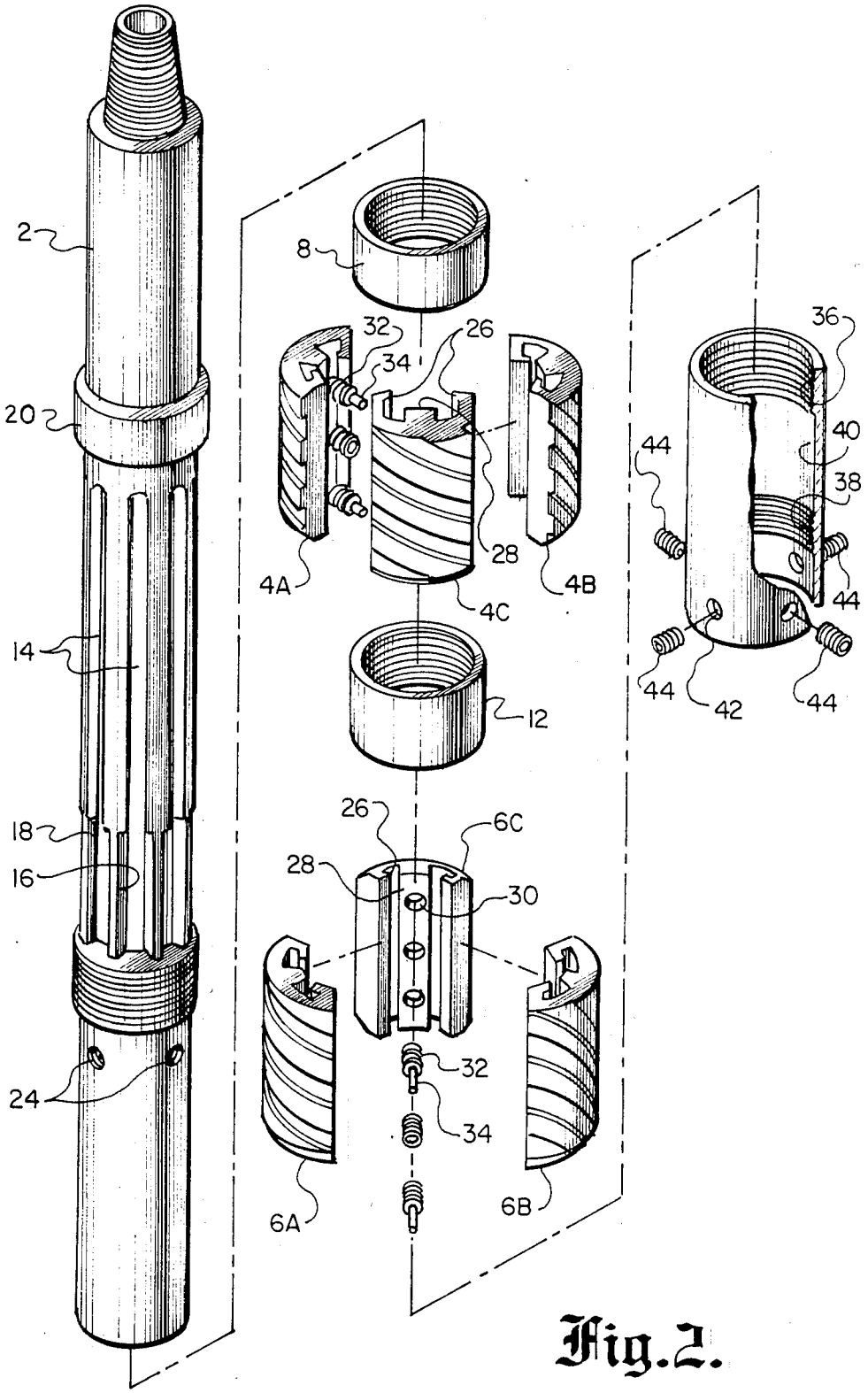
FIG. 2 is an exploded view showing the various components of the casing scraper.

The improved casing scraper of the present invention is shown in assembled form in FIG. 1, and disassembled in FIG. 2. The scraper includes a mandrel or body portion 2 preferably formed from an alloy steel and heat treated for strength and durability. Upper and lower sets of scraper blades 4 and 6 are affixed to the body. The blades are designed to provide a large cutting surface area for vertical and rotational scraping, and to provide an optimal shearing action with a minimal amount of restriction to returning well fluid. The blades are preferably formed from cast steel and are heat treated to provide a long service life.

The scraper blades are retained on the body between an upper retainer ring 8 and a lower elongated retainer ring 10, with a central spacer ring 12 separating the two sets of blades. As explained in further detail below, lower retainer ring 10 is easily screwed off the body for disassembly of the scraper and replacement of worn blades, but is provided with a special design such that it is positively secured on the body during operation and will not come off, even under heavy scraping loads.

Details of the various components are shown in the exploded view of FIG. 2. A series of longitudinal splines 14 are formed integrally with the scraper body, and extend parallel to the body axis along the central portion of the body. Each spline consists of a base member 16 in the form of a longitudinal rib which extends radially outward from the body, and a lip 18 which flares transversely from each side of the rib toward its outer end. The lips 18 are terminated toward the lower ends of their respective base members, leaving a loading area below the lip for loading the cutting blades. The loading area is slightly longer than the length of the blades to facilitate easy loading and unloading.

An annular stop 20 is integrally formed around the body immediately above the splines, while an annular threading 22 is formed around the body immediately below the splines. The annular threading 22, as well as the internal threading on the various retainer rings, utilizes blunt start, 4 pitch square threads. Immediately below the threading 22 are a plurality of threaded set screw openings 24 spaced around the body.

The upper set of blades 4 consists of three separate scraper blades 4A, 4B and 4C, while the lower set of blades 6 consists of three similar separate blades 6A, 6B and 6C. Each of the blades has an outer cutting area defining the cutting surfaces, a pair of angled retainer arms 26 at each end which positively hold the cutting blade onto the splines, and a rectangular boss 28 which extends inwardly from the central portion of the blade and lodges between the lips of adjacent splines. Each boss 28 has three spaced openings 30 extending in from its outer surface. Openings 30 receive corresponding coil springs 32, with stops 34 being inserted into the upper and lower springs. The construction of the scraper blades is such that they are permitted a certain amount of radial play when mounted on the scraper body. Springs 32 maintain an outward pressure on the blades, while allowing for variations in the inner casing diameter.

The scraper blades are loaded onto the splines at the loading area below the termination of lips 18, and are then slid upwardly into place with the blade retainer arms 26 riding under the opposite lips of adjacent splines. The relationship between the cutting blades and splines is best seen in FIG. 3, which is a cross-sectional view showing the blades in place on the body. Each blade occupies a pair of adjacent splines, and abuts against the adjacent blades on either side. As shown in FIG. 1, the lower set of blades is preferably rotatably offset from the upper set by one spline, or 60°.

Referring back to FIG. 2, the bottom retainer ring 10 has upper and lower spaced sets of inside threading 36 and 38, respectively, with a gap 40 between the two sets of threads. Gap 40 is longer than the longitudinal dimension of annular body threading 22, such that a certain amount of longitudinal play is permitted when the lower ring is screwed onto the body with its upper threading 36 above and its lower threading 38 below the annular body threading 22. The longitudinal dimensions of retainer ring 10, blades 6, annular threading 22 and the spline loading area below lips 18 are selected such that, with the annular body threading 22 positioned in the lower ring threading gap 40, retainer ring 22 holds blade 6 up to a position at which the blades are still held on the scraper body by engagement with spline lips 18. This situation is illustrated in FIG. 4, in which the blades are shown in dashed lines.

Referring back to FIG. 2 again, a plurality of threaded set screw openings 42 are formed in the lower end of retainer ring 10 below lower threading 38. These openings 42 align with openings 24 in the scraper body when the retainer ring is advanced to a full retaining position on the body, permitting set screws 44 to be screwed into openings 42 and 24 to hold the lower retaining ring in place. In addition, the orientation of the threading on the various retainer rings and on the body annular threading 22 is reversed from the scraper's direction of rotation in normal use. In this manner, normal rotation of the scraper tends to tighten up the lower retainer ring against the scraper blades, and to resist the ring becoming unscrewed.

The scraper is assembled by first screwing the top retainer ring past annular threading 22 on the body and sliding it along the splines to stop 20. The upper set of blades 4, after their associated springs have been put in place, are then loaded at the bottom of the splines and slid upwardly to top retainer ring 8, with the blade retainer arms engaging the undersides of the outer lips on adjacent splines. Center spacer ring 12 is then screwed on past annular threading 22 and slid up into abutment with the lower side of blades 4, after which lower cutting blades 6 are assembled in a manner similar to blade 4. In each case the blades are set over the lower end of two adjacent splines, and urged radially inward and upward until it locks securely onto the body splines. As described above, the lower set of blades are offset from the upper set by one spline, or 60°. Finally, lower retaining ring 10 is screwed on all the way so that its lower set of threading 38 engages the annular body threading 22, and its upper edge is abutting against the lower edge of blade 6. Set screws 44 are then inserted through the aligned set screw openings in the lower retaining ring and body. In this manner the blades are held securely in place against longitudinal movement by the retainer rings, and against radial movement by the integrally formed body splines.

Once assembled, the casing scraper of the present invention is extremely resistant to unintentional disassembly under operating conditions. The engagement between the blade retainer arms and the body splines produces a positive retention force along the entire length of the blades which holds them onto the body. The only way the blades can come off is by sliding them down the splines and out the loading area, but the lower retention ring 10 prevents this from happening. First, the retention ring is fastened in place to the body by a plurality of set screws. Even if some of the set screws should come out, counter rotation of the ring is prevented by the remaining set screws. If all of the set screws should come out, the ring will still normally stay on the body in use because its threading is such that normal rotation of the scraper will tend to tighten it up against the blades, rather than causing it to unscrew. If somehow all of the set screws should come out and the ring should become unscrewed beyond its lower set of threading, it will still be held onto the body because, with the annular body threading 22 located in the gap 40 between the two sets of ring threadings, the ring will tend to vibrate about the annular threading. This vibration has been found to resist any engagement of the upper set of ring threading 36 with the annular body threading 22. In this position the cutting blades will still be held by the splines and prevented from exiting through the loading area, and the scraper can still be operated.

While a particular embodiment of the invention has been shown and described, numerous variations and alternate embodiments will occur to those skilled in the art. Accordingly, it is intended that the invention be limited only in terms of the appended claims.

I claim:

1. In a well casing scraper having an elongate body adapted to be lowered into a well casing and a plurality of scraper blades mounted on the body for cleaning the interior of the casing when the body is rotated, the improvement comprising:

a plurality of splines spaced around the circumference of the body and extending longitudinally along a portion thereof, each of the scraper blades being provided with means for engaging respective splines to enable the blades to be slid along the splines to desired positions, said engaging means retaining the blades on the splines against outward movement away from the body, said splines including a loading area for receiving the blades, and means for restraining the blades from longitudinal movement on the splines after the blades have been slid to a cutting position, said means restraining the blades from longitudinal movement comprising a blade stop means spaced from the loading area and to one side thereof, an annular threading around the body on the other side of the loading area, and a retainer ring having first and second spaced sets of interior threading with a gap between the two sets which is wider than the longitudinal extent of the annular threading, the ring being adapted to be screwed over the annular threading to a blade retaining position with the first set of threading extending beyond the annular threading towards the blades and the second set of threading engaging the annular threading, the relative dimensions of the ring, blades, annular threading and spline loading area being selected so that, if the ring becomes unscrewed to the extent that the annular threading is within the gap between the two sets of ring threading, the blades are still retained on the splines by the ring.

2. The casing scraper of claim 1, each of said splines including a longitudinal base member extending away from the body, and a lip extending longitudinally along the base member and spaced from the body, each of said blades including a pair of arms for engaging the lips of adjacent splines to retain the blade thereon.

3. The casing scraper of claim 2, the blade retainer arms engaging the undersides of the lips of adjacent splines, each blade further including a boss adapted to protrude between its respective adjacent splines.

4. The casing scraper of claim 1, said means restraining the blades from longitudinal movement comprising a blade stop means spaced from the loading area and to one side thereof, an annular threading around the body on the other side of the loading area, and a threaded retainer ring adapted to be screwed over the annular threading to longitudinally retain the blades on the splines, the threading orientation being reversed from the scraper's direction of rotation in normal use, whereby under normal rotation the retainer ring is urged further onto the threading and against the blades.

5. The casing scraper of claim 4, said body and retainer ring each including a plurality of threaded set screw openings which align with each other when the ring is screwed on to a retaining position, whereby the ring may be further retained on the body by the insertion of set screws into the aligned openings.

6. The casing scraper of claim 1, the orientation of the threading on the body and retainer ring being reversed from the scraper's direction of rotation in normal use, whereby under normal rotation the retainer ring is urged further onto the annular threading and against the blades.

7. The casing scraper of claim 1, said body and retainer ring each including a plurality of threaded set screw openings which mate when the ring is screwed on to a retaining position, whereby the ring may be further held on the body by the insertion of set screws into the mating openings.

8. In a well casing scraper having a body adapted to be lowered into a well casing, a plurality of scraper blades carried on the body with a longitudinal freedom of movement for cleaning the interior of the casing when the body in rotated, and means for restraining the blades form longitudinal movement along the body, the improvement comprising:

a stop means carried by the body on one longitudinal side of the blades, an annular threading around the body on the other longitudinal side of the blades, and a retainer ring having first and second spaced sets of interior threading with a gap between the two sets which is wider than the longitudinal extent of the annular threading, the ring being adapted to be screwed over the annular threading to a blade restraining position with the first set of threading extending beyond the annular threading towards the blades and the second set of threading engaging the annular threading, the relative dimensions of the ring, blades and annular threading being selected so that, if the ring becomes unscrewed to the extent that the annular threading is within the gap between the two sets of ring threading, the blades are at least partially restrained from longitudinal movement by the ring.

9. The casing scraper of claim 8, the orientation of the threading on the body and retainer ring being reversed from the scraper's direction of rotation in normal use, whereby under normal rotation the retainer ring is urged further onto the annular threading and against the blades.

10. The casing scraper of claim 8, said body and retainer ring each including a plurality of threaded set screw openings which align with each other when the ring is screwed on to a retaining position, whereby the ring may be further held on the body by the insertion of set screws into the aligned openings.

* * * * *